United States Patent [19]

Laemmle et al.

[11] Patent Number: 4,670,168

[45] Date of Patent: Jun. 2, 1987

[54] AQUEOUS METAL REMOVAL FLUID

[75] Inventors: Joseph T. Laemmle, Murrysville; John Bohaychick, New Kensington, both of Pa.

[73] Assignee: Aluminum Company of America, Pittsburgh, Pa.

[21] Appl. No.: 858,118

[22] Filed: May 1, 1986

[51] Int. Cl.[4] ..... C10M 173/02

[52] U.S. Cl. ..... 252/42; 252/49.3; 252/56 D; 252/52 A

[58] Field of Search ..... 252/49.3, 42, 56 D

[56] References Cited

U.S. PATENT DOCUMENTS

| | | | |
|---|---|---|---|
| 3,256,187 | 6/1966 | Davis | 252/34 |
| 3,271,310 | 9/1966 | Le Suer | 252/56 D |
| 3,583,914 | 6/1971 | Garvin et al. | 252/42 |
| 3,658,704 | 4/1972 | Curtis | 252/42 |
| 3,970,569 | 7/1976 | Sturwold | 252/49.3 |
| 4,067,817 | 1/1978 | Sturwold | 252/49.3 |
| 4,257,902 | 3/1981 | Singer | 252/18 |
| 4,292,186 | 9/1981 | Chibnik et al. | 252/56 D |
| 4,317,740 | 3/1982 | Eisenhard | 252/49.3 |
| 4,382,002 | 5/1983 | Walker et al. | 252/49.3 |
| 4,388,198 | 6/1983 | Butcosk | 252/42 |
| 4,452,712 | 6/1984 | Laemmle | 252/49.3 |
| 4,486,324 | 12/1984 | Korosec | 252/49.3 |
| 4,505,830 | 3/1985 | Vinci | 252/33 |

*Primary Examiner*—William R. Dixon, Jr.
*Assistant Examiner*—Ellen M. McAvoy
*Attorney, Agent, or Firm*—Glenn E. Klepac

[57] ABSTRACT

An aqueous metalworking composition comprising about 2–20 wt % of a water-soluble polyglycol, about 0.6–12 wt % of a neutralized or partially neutralized alkyl or alkenyl substituted succinic acid, and water. The composition is especially suitable for metalworking operations such as cutting, grinding, turning, milling, and drilling on aluminum and aluminum alloys.

20 Claims, 1 Drawing Figure

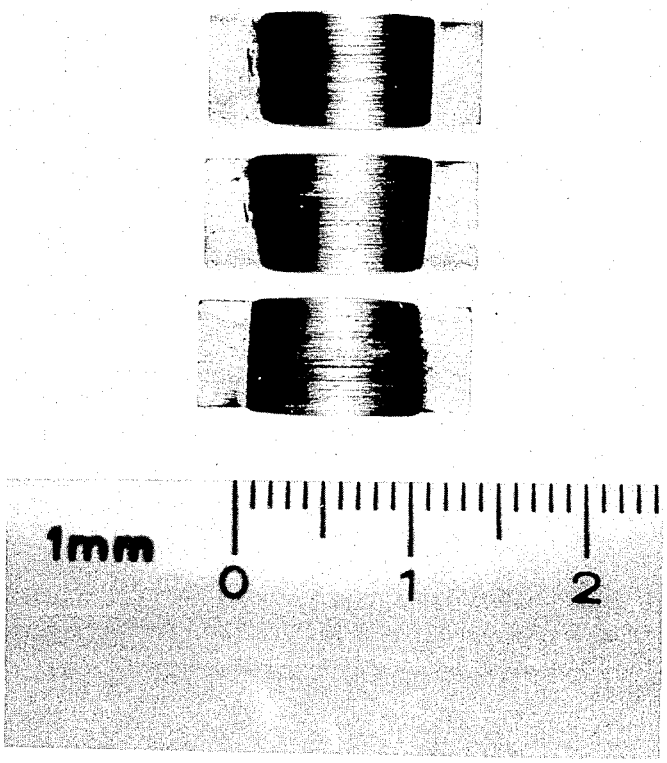
1mm
0
1
2

AQUEOUS METAL REMOVAL FLUID

FIELD OF THE INVENTION

The present invention relates to aqueous compositions that are suitable for use as lubricants and coolants in various metal machining operations, including cutting, grinding, turning, milling, and drilling.

BACKGROUND OF THE INVENTION

In the machining of metals, it is customary to flood the tool and workpiece with a coolant for the purpose of carrying off heat which is produced during the operation. These coolants are typically employed in combination with various agents having lubricating and extreme-pressure properties for reducing friction, especially in tapping and broaching operations. It has heretofore been the practice to employ for such purposes aqueous compositions containing lubricating agents such as emulsified petroleum or non-petroleum additives. Such aqueous cutting fluids or metal removal fluids should meet several important requirements.

Among the requirements for a satisfactory metal removal fluid are chemical stability under normal operating conditions, corrosion-inhibiting properties for both the tool and workpiece, and absence of ingredients which might be noxious to workers or the environment. It is also important for the fluid to avoid leaving deposits or stains on the tool and workpiece following the machining operation. Other important requirements include avoidance of tacky residues that might interfere with the machining operation and avoidance of excessive foam formation.

Numerous metal removal fluids are known in the prior art. However, there is still a need to provide new compositions capable of accomplishing their intended purpose more efficiently than the prior art fluids.

Davis U.S. Pat. No. 3,256,187 relates to an aqueous cutting fluid comprising the combination of an alkanolamine and an organic acid containing about 6 to 12 carbon atoms per molecule, and an alkenyl succinic anhydride. The anhydride is converted to an amine salt in the presence of triethanolamine and water. This cutting fluid may also contain an alkali metal hydroxide.

Singer U.S. Pat. No. 4,257,902 discloses a water-based fluid that is suitable for metal shaping operations. The fluid contains (a) a major amount of water, (b) a minor amount of sulfur- or chlorosulfur-containing E.P. agent that is water-insoluble and oil-soluble, (c) a minor amount of a water-soluble organic dispersing agent which may be a polyglycol, and (d) at least one water-soluble polymeric thickener.

Vinci U.S. Pat. No. 4,505,830 claims a water-free metalworking lubricant containing a major amount of a lubricating oil, a minor amount of a basic alkali metal salt of at least one acidic organic compound, and a minor amount of at least one sulfurization product of an olefinic hydrocarbon. The synthetic lubricating oil may be a polyglycol or one of the esters of various dicarboxylic acids, including alkyl succinic acids and alkenyl succinic acids.

A principal objective of the present invention is to provide an aqueous composition that functions efficiently as a metal removal fluid.

A related objective of the invention is to provide a method of metalworking, utilizing the claimed composition.

Additional objects and advantages will become apparent to persons skilled in the art from the following specification and claims.

SUMMARY OF THE INVENTION

In accordance with the present invention, there is provided an aqueous metalworking composition comprising about 2–20 wt% of a water-soluble polyglycol, about 0.6–12 wt% of a neutralized or partially neutralized alkyl or alkenyl substituted succinic acid, and water.

The polyglycol is selected from the group consisting of polyoxypropylene glycols, polyoxyethylene glycols, random or block polyoxyethylene-polyoxypropylene copolymers, and mixtures of such polyglycols. Average molecular weight may be about 200 to 4,000, depending upon the type of polyglycol and properties desired in the composition. Polyglycols having solubility in water of at least about 20 grams per liter at 20° C. are preferred.

The polyglycol preferably comprises about 2–10 wt% of the composition, more preferably about 3–7 wt%. Compositions comprising about 5 wt% polyglycol are particularly preferred.

$$\begin{array}{l} R-CHCOOM \\ \quad\;\; | \\ \quad CH_2COOM \end{array} \quad \text{or} \quad \begin{array}{l} R-CHCOOM \\ \quad\;\; | \\ \quad CH_2COOH \end{array}$$

wherein R is a straight or branched chain, saturated or unsaturated $C_5$–$C_{18}$ group and M is K, Na, or Li. R is preferably a $C_{10}$–$C_{14}$ straight chain alkyl or alkenyl group and more preferably a 2-dodecenyl group. The potassium salts are also preferred.

The succinate preferably comprises about 2–10 wt% of the composition, more preferably about 4–9 wt%. Compositions comprising about 6 wt% of a potassium salt of 2-dodecenyl succinic acid are utilized in some preferred embodiments.

The aqueous metalworking composition may also contain other suitable additives, including antioxidants, biocides, antifoam agents, copper corrosion inhibitors, and chelating agents. One suitable oxidation inhibitor is N,N, diethyl hydroxylamine at a concentration of about 0.025 wt%. Concentrations of about 0.01–0.5 wt% are effective. A suitable biocide is sold under the trade name "Lauriciden" by Napp Industries and is also utilized at a concentration of about 0.025 wt%.

The remainder of the composition comprises distilled or deionized water. Water typically comprises about 70–97 wt% of the composition, preferably about 84–93 wt%.

The metalworking method of the invention is performed by applying to a metal object a synthetic aqueous composition consisting essentially of about 2–20 wt% of the water-soluble polyglycol, about 0.6–12 wt% of the neutralized or partially neutralized alkyl- or alkenyl-substituted succinic acid, and remainder, water. A metalworking operation is then performed on the metal object. The metal object preferably comprises aluminum or an aluminum alloy. Compositions consisting essentially of about 2–10 wt% of the polyglycol and about 2–10 wt% of the succinate are preferred.

BRIEF DESCRIPTION OF THE DRAWING

The sole Figure is a photograph showing three specimens of an aluminum alloy treated in accordance with the method of the invention.

DESCRIPTION OF SPECIFIC EMBODIMENTS

The aqueous metalworking composition of the invention comprises a synergistic combination of a water-soluble polyglycol with a partially to fully neutralized alkyl or alkenyl succinic acid. Although both the polyglycol and the acid have been employed separately in prior art lubricant compositions, their combination provides results superior to what can be achieved by using either ingredient alone.

The water-soluble polyglycol has the general formula $$R_4(OCH_2CHR_1)_x(OCH_2CHR_2)_y(OCHR_3CH_2)_zOR_4$$

wherein $R_1$, $R_2$, and $R_3$ are each H or $CH_3$, $R_4$ is H, $CH_3$, $C_2H_5$, $C_3H_7$, or $C_4H_9$, x, y, z are chosen to provide a total average molecular weight of about 200 to 4,000, and the polymers are in either random or block form.

One suitable polyglycol is a water-soluble mixture of polyoxyethylene-polyoxypropylene-polyoxyethylene block copolymers containing a single polyoxyethylene chain and two polyoxypropylene chains attached to the polyoxyethylene chain. The average molecular weight of polyoxypropylene chains in the mixture is at least 900, and the polyoxyethylene chains constitute about 10–80 wt% of the mixture. Average molecular weight of polyoxypropylene chains in the mixture is preferably about 1,000 to 3,100. In a preferred mixture, the average molecular weight of polyoxypropylene chains in the mixture is about 1700, and the polyoxyethylene chains constitute about 20 wt% of the mixture. This preferred material is sold under the trade name "Pluronic 17R2" by BASF Wyandotte Corporation of Wyandotte, Mich.

The polyoxypropylene-polyoxyethylene-polyoxypropylene block copolymers are made by sequential addition of ethylene oxide and then propylene oxide to an ethylene glycol base. These conjugated or block copolymers are described in Jackson et al U.S. Pat. No. 3,036,118 issued May 22, 1962. The disclosure of said Jackson et al patent is incorporated herein by reference to the extent not inconsistent with the present invention.

The water-soluble polyglycol may also be a random or heteric copolymer made by copolymerizing mixtures of ethylene oxide and propylene oxide. Such copolymers are described in Toussaint et al U.S. Pat. No. 2,425,845. The disclosure of said Toussaint et al patent is incorporated herein by reference to the extent not inconsistent with the present invention. The ratio of oxyethylene groups to oxypropylene groups in such copolymers generally ranges from about 3:1 to 1:3. Average molecular weights of suitable copolymers are about 900 to 4,000. Average viscosities are about 55 to 5,000 SSU at 100° F. These random copolymer mixtures are sold under the trade designation "Ucon" by Union Carbide Corporation. A particularly suitable random copolymer mixture is sold under the trade designation "Ucon 50 HB 260".

The succinate is made by neutralizing or partially neutralizing a suitable substituted succinic acid or succinic anhydride with KOH, NaOH, or LiOH. One suitable succinate is made by reacting 2-dodecenyl succinic anhydride with KOH in aqueous solution. Some other suitable succinate precursors are n-pentenyl succinic anhydride, octenyl succinic anhydride, nonenyl succinic anhydride, and decenyl succinic anhydride.

The following are some examples of metalworking compositions made in accordance with the present invention.

| Example | Ingredient | Content (wt %) |
|---|---|---|
| A. | Mixture of polyoxypropylene-polyoxyethylene-polyoxypropylene block copolymers, M.W. of polyoxypropylene chains = 1700, polyoxyethylene chains about 20 wt % of the mixture (Pluronic 17R2) | 5.0 |
| | 2-dodecenyl succinic acid | 5.0 |
| | KOH | 1.8 |
| | Water | 88.2 |
| B. | Mixture of random polyoxyethylene-polyoxypropylene copolymers, in which polyoxyethylene chains are about 50 wt % of the mixture, viscosity about 260 SSU at 100° F. (Ucon 50 HB 260) | 5.0 |
| | 2-dodecenyl succinic acid | 5.0 |
| | KOH | 1.8 |
| | Water | 88.2 |
| C. | Polypropylene glycol 600 | 5.0 |
| | 2-dodecenyl succinic acid | 5.0 |
| | KOH | 1.8 |
| | Water | 88.2 |
| D. | Polyethylene glycol 400 | 5.0 |
| | 2-dodecenyl succinic acid | 5.0 |
| | KOH | 1.8 |
| | Water | 88.2 |

Each of the compositions listed above were evaluated as aluminum removal fluids in grinding operations utilizing ring on block tests. The apparatus employed to evaluate the compositions is described in ASTM D-2714. These tests were performed at 800 rpm with a 36-pound load, using a steel ring having surface roughness of about $25–28\times10^{-6}$ inch and specimens of AA 5182-0 aluminum alloy. Samples of some specimens after testing are shown in the drawing. Test results are summarized in Table I. Wear readings shown represent an average of three one-minute runs. Ratios were calculated by dividing wear readings for each composition tested by the wear reading for Commercial Fluid (1).

TABLE I

| Composition | $10^2$ Wear (mg) | Ratio |
|---|---|---|
| Commercial Fluid (1) | 0.66 ± 0.18 | 1.0 |
| Commercial Fluid (2) | 1.26 ± 0.35 | 1.9 |
| 5 wt % 2-dodecenyl succinic acid + 1.8 wt % KOH + 93.2 wt % water | 2.30 ± 0.70 | 3.5 |
| 5 wt % Pluronic 17R2 + 95 wt % water | 1.45 ± 0.40 | 2.2 |
| Example A | 5.62 ± 0.55 | 8.5 |
| Example B | 5.40 ± 0.07 | 8.2 |
| Example C | 5.48 ± 0.50 | 8.3 |
| Example D | 4.41 ± 0.09 | 6.7 |

The Example A composition also passed a modified version of the ASTM D-665 rust test performed at 140° F. for 24 hours. In addition, it did not stain a partially submerged coupon of aluminum alloy AA 3003 after 48 hours.

While the invention has been described in terms of preferred embodiments, the claims appended hereto are intended to encompass all embodiments which fall within the spirit of the invention.

What is claimed is:

1. An aqueous metalworking composition comprising (a) about 2–20 wt% of a water-soluble polyglycol selected from the group consisting of polyoxypropylene glycols, polyoxyethylene glycols, random or block polyoxyethylene-polyoxypropylene copolymers, and mixtures thereof, (b) about 0.6–12 wt% of a neutralized or partially neutralized alkyl or alkenyl succinic acid having the formula

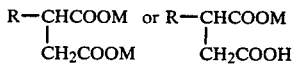

wherein R is a straight or branched chain, saturated or unsaturated $C_5$–$C_{18}$ group and M is K, Na, or Li, and (c) water.

2. The composition of claim 1 comprising about 2–10 wt% of the polyglycol and about 2–10 wt% of the alkyl or alkenyl succinic acid.

3. The composition of claim 1 comprising about 3–7 wt% of the polyglycol and about 4–9 wt% of the alkyl or alkenyl succinic acid.

4. The composition of claim 1 wherein said polyglycol comprises a mixture of polyoxyethylene-polyoxypropylene block copolymers containing a single polyoxyethylene chain and two polyoxypropylene chains attached to the polyoxyethylene chain.

5. The composition of claim 1 wherein said polyglycol comprises a mixture of random polyoxyethylene-polyoxypropylene copolymers.

6. The composition of claim 1 wherein R is a $C_{10}$–$C_{14}$ straight chain alkyl or alkenyl group.

7. The composition of claim 1 wherein R is a $C_{10}$–$C_{14}$ alkyl or alkenyl group.

8. The composition of claim 1 wherein R is a 2-dodecenyl group.

9. The composition of claim 1 wherein said succinic acid is fully neutralized.

10. The composition of claim 1 wherein M is K.

11. The composition of claim 1 further comprising (d) an effective concentration of an oxidation inhibitor.

12. An aqueous metalworking composition consisting essentially of (a) about 2–20 wt% of a water-soluble polyglycol selected from the group consisting of polyoxypropylene glycols, polyoxyethylene glycols, random or block polyoxyethylene-polyoxypropylene copolymers, and mixtures thereof, (b) about 0.6–12 wt% of a neutralized or partially neutralized alkyl or alkenyl succinic acid having the formula

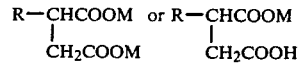

wherein R is a straight or branched chain, saturated or unsaturated $C_5$–$C_{18}$ group and M is K, Na, or Li, and (c) about 70–97 wt% water.

13. The composition of claim 12 consisting essentially of about 3–7 wt% of the polyglycol, about 4–9 wt% of the alkyl or alkenyl succinic acid and about 84–93 wt% water.

14. A method of metalworking comprising the steps of (a) applying to a metal object a synthetic aqueous composition comprising (1) about 2–20 wt% of a water-soluble polyglycol selected from the group consisting of polyoxypropylene glycols, polyoxyethylene glycols, random or block polyoxyethylenepolyoxypropylene copolymers, and mixtures thereof, (2) about 0.6–12 wt% of a neutralized or partially neutralized alkyl or alkenyl succinic acid having the formula

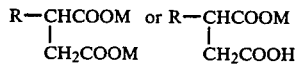

wherein R is a straight or branched chain, saturated or unsaturated $C_5$–$C_{18}$ group and M is K, Na, or Li, and (3) remainder, water, and (b) performing a metalworking operation on the metal object.

15. The method of claim 14 wherein said metal object comprises aluminum or an aluminum alloy and step (b) comprises cutting, grinding, turning, milling, or drilling said metal object.

16. The method of claim 14 wherein said composition comprises about 2–10 wt% of the polyglycol and about 2–10 wt% of the succinic acid.

17. The method of claim 14 wherein said polyglycol comprises a mixture of polyoxyethylene-polyoxypropylene block copolymers containing a single polyoxyethylene chain and two polyoxypropylene chains attached to the polyoxyethylene chain.

18. The method of claim 14 wherein R is a 2-dodecenyl group.

19. The method of claim 14 wherein M is K.

20. The composition of claim 12 consisting of about 2–20 wt% of the polyglycol, about 0.6–12 wt% of the alkyl or alkenyl succinic acid and about 70–97 wt% waterl and wherein R is a $C_{10}$–$C_{14}$ alkyl or alkenyl group.

* * * * *

UNITED STATES PATENT AND TRADEMARK OFFICE

CERTIFICATE OF CORRECTION

PATENT NO. : 4,670,168

DATED : June 2, 1987

INVENTOR(S) : Joseph T. Laemmle and John Bohaychick

It is certified that error appears in the above-identified patent and that said Letters Patent is hereby corrected as shown below:

| | |
|---|---|
| Col. 2, line 25 | Insert the following paragraph: --The substituted succinate has the formula--. |
| Claim 14, Col. 6, lines 21-22 | Change "polyoxyethylenepolyoxypropylene" to --polyoxyethylene-polyoxypropylene--. |
| Claim 20, Col. 6, line 55 | Change "waterl" to --water--. |

Signed and Sealed this

Eighteenth Day of August, 1987

*Attest:*

DONALD J. QUIGG

*Attesting Officer*

*Commissioner of Patents and Trademarks*